US008973482B2

(12) United States Patent
Malavalli

(10) Patent No.: US 8,973,482 B2
(45) Date of Patent: Mar. 10, 2015

(54) SUSPENDED FLOOR DEVICE

(75) Inventor: Anantha M Malavalli, West Bloomfield, MI (US)

(73) Assignee: International Truck Intellectual Property Company, LLC, Lisle, IL (US)

( * ) Notice: Subject to any disclaimer, the term of this patent is extended or adjusted under 35 U.S.C. 154(b) by 0 days.

(21) Appl. No.: 14/233,425

(22) PCT Filed: Jul. 26, 2011

(86) PCT No.: PCT/US2011/045289

§ 371 (c)(1), (2), (4) Date: Jan. 17, 2014

(87) PCT Pub. No.: WO2013/015784

PCT Pub. Date: Jan. 31, 2013

(65) Prior Publication Data

US 2014/0165824 A1 Jun. 19, 2014

(51) Int. Cl.

| | |
|---|---|
| ***F41H 7/02*** | (2006.01) |
| ***F41H 7/04*** | (2006.01) |
| ***F41H 5/007*** | (2006.01) |

(52) U.S. Cl.

CPC ..... *F41H 7/042* (2013.01); *F41H 5/007* (2013.01)

USPC ..... 89/36.08; 89/929

(58) Field of Classification Search

CPC ..... F41H 7/042

USPC ..... 89/36.08, 36.09, 929; 296/187.07

See application file for complete search history.

(56) References Cited

U.S. PATENT DOCUMENTS

| | | | | |
|---|---|---|---|---|
| 6,779,431 | B2 * | 8/2004 | Honlinger | 296/193.07 |
| 7,631,589 | B2 * | 12/2009 | Hunn et al. | 89/36.02 |
| 7,908,959 | B2 * | 3/2011 | Pavon | 89/36.17 |
| 7,914,069 | B2 | 3/2011 | Barbe | |
| 2008/0111396 | A1 * | 5/2008 | Barbe et al. | 296/187.08 |
| 2013/0220108 | A1 * | 8/2013 | Oriet | 89/36.08 |
| 2014/0007761 | A1 * | 1/2014 | Haidar | 89/36.02 |

OTHER PUBLICATIONS

Search Report from corresponding PCT application entitled Suspended Floor Device, Dec. 22, 2011.

* cited by examiner

*Primary Examiner* — Reginald Tillman, Jr.

(74) *Attorney, Agent, or Firm* — Jeffrey P. Calfa; Mark C. Bach

(57) ABSTRACT

A blast dissipation device for an armored vehicle includes a first absorption system and a second absorption system that are usable to dissipate initial blast forces exerted upon an underbelly of the vehicle caused by, for example, detonation of an IED below the vehicle. The second absorption system has a delayed reaction to forces exerted upon the underbelly of the vehicle. The first absorption system reacts more quickly and serves to dissipate initial forces until the second absorption system is activated to dissipate the remaining forces.

14 Claims, 1 Drawing Sheet

SUSPENDED FLOOR DEVICE

TECHNICAL FIELD

The present device relates to a blast dissipating system for improving the protection of a vehicle, occupants lower extremities. More specifically, the device aides in the dissipation of shockwaves, displacement and other forces exhibited on the underbelly of a vehicle caused, for example, by detonation of an explosive device below the vehicle.

BACKGROUND

Armored vehicles are threatened by improvised explosive devices (IEDs) designed to cause harm to the vehicle and its occupants. IEDs are typically one or more grouped artillery shells redeployed and detonated in an effort to inflict casualties. These explosive devices when detonated beneath a floor of a vehicle, these explosive devices often create localized deformation of the floor of the vehicle thereby transmitting large vertical loads onto the lower extremities of occupants of the vehicle. For example, detonations below the underbelly of an armored vehicle may cause the vehicle floor to accelerate at 100G or more and reach velocities of 7 to 12 m/s over a time period of 3 to 5 msec. These high rates of acceleration and velocity transmit large mechanical forces on the lower extremities of the occupants within the vehicle cabin.

Armor countermeasures typically consist of heavy metal plates placed between the threat and the vehicle in such a way as to resist hull breach and aggressive floor accelerations. These heavy metal plates also work in concert with layers of additional metal, ceramic, composite or plastic materials designed to prevent lethal high velocity artillery shell fragments from entering the vehicle. The heavy metal plates are typically mounted to the underside of the vehicle in a V-shape in an effort to take advantage of shape efficiency and deflection characteristics when presented with incoming pressure and fragmentation. Carrying a heavy blast and fragment resistant hulls results in significant performance disadvantage to the vehicle in terms of reduced fuel economy, lost cargo capacity and increased transportation shipping costs.

The present device usable, for example, in a personnel cabin of a vehicle, includes a two stage dissipating system for dissipating the blast forces from an explosive device. The device includes an absorbent mat, a suspended floor, and an air bag, which is deflated through use of a blast sensing apparatus. The absorbent mat, air bag and suspended floor help improve the dissipation of forces exerted on the underbelly of the vehicle while avoiding the negative tradeoffs of alternative designs.

SUMMARY

There is disclosed herein a system and method, each of which avoids the disadvantages of prior systems and methods while affording additional structural and operating advantages.

Generally speaking, a blast dissipating device for use in protecting occupants in a vehicle is disclosed. The device is provided as a separate device that may be installed into the floor of a vehicle. The device is provided with a two-stage absorption system including a first and a second absorption system, and is designed to allow for increased relative motion between the body of the vehicle and the lower extremities of occupants within the vehicle. That is, the device allows the body of the vehicle, such as the floating floor, to move a greater distance before exerting a force on the lower extremities of the occupants of the vehicle.

In an embodiment, a blast dissipating device usable within the interior of a personnel cabin of a vehicle is disclosed. The device comprises a first absorption system responsive immediately to deformation forces exerted on an underbelly of the vehicle to dissipate the forces, and a second absorption system responsive after the first absorption system to further dissipate the forces. In general, the second absorption system may be initiated after the first absorption system has dissipated the maximum amount of energy it is capable of dissipating. Alternatively, the second absorption system may be initiated before the first absorption system has reached a maximum level of dissipation.

In another embodiment, first absorption system is an absorbent mat, while the second absorption system is an air bag system. The air bag system is a pneumatic air bag system. The pneumatic air bag system comprises a bladder, at least one input valve, at least one release valve, and a blast sensing diaphragm.

In another embodiment, the diaphragm deforms in response to a force exerted upon the underbelly of the vehicle to a predetermined limit, activating the at least one release valve to release air from within the bladder to help dissipate the forces exerted upon the underbelly of the vehicle.

A method of absorbing at least a portion of a force exerted upon the underbelly of a vehicle, is disclosed. The method comprises the steps of activating a first absorption system to dissipate an initial force exerted upon the underbelly of the vehicle; and, activating a second absorption system to dissipate the remaining force exerted upon the underbelly of the vehicle, wherein the second absorption system is activated after the first absorption system.

In yet another embodiment, the method comprises first stage energy absorption system via an energy absorbing floor mat. The second stage absorption system comprises deforming a diaphragm of an air bag system, activating a release valve of the air bag system, and releasing air from within a bladder of the air bag system to lower an air pressure of the air bag system, and wherein the release valve is activated after the energy absorbing mat has been at least partially deformed.

These and other features and advantages of the present device and methods can be more readily understood from the following detailed discussion with reference to the appended drawing figures.

DETAILED DESCRIPTION

Figure 2:
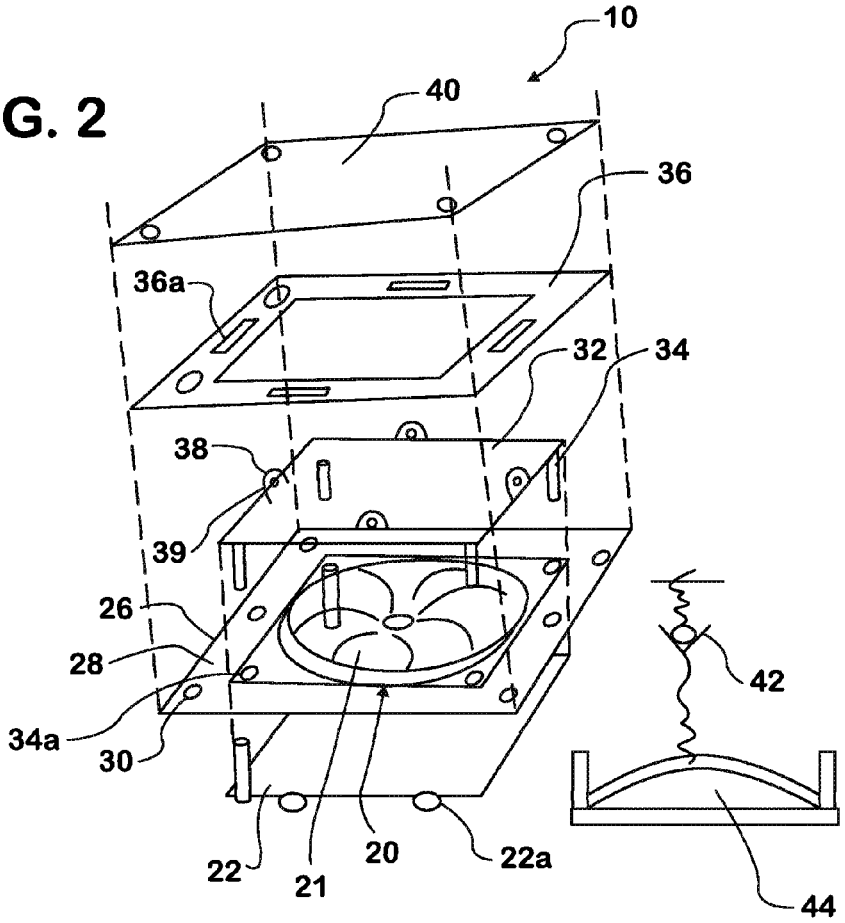
Figure 1:
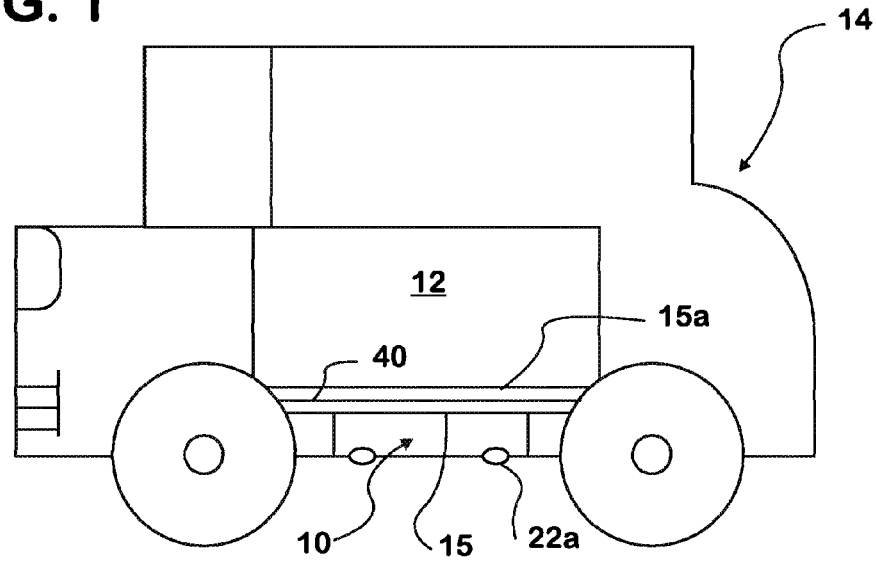
FIG. 1 is a perspective view of a vehicle with the present blast dissipation device installed therein; and, FIG. 2 is a schematic exploded view of an exemplary embodiment of a blast dissipation device.

Referring to FIGS. 1 and 2, there is illustrated an exemplary embodiment of a blast dissipating device and system or safety floor, generally designated by the numeral 10, as well as the components thereof. The device 10 is designed for use as a blast dissipation system in the underbelly or floor of a personnel cabin 12 of a vehicle 14, particularly a military vehicle, which is used in war-zones for transporting personnel or cargo. This device 10 will allow more relative motion between the vehicle floor structure and the vehicle occupants' lower extremities, reducing injury to the occupants.

As shown in FIG. 2, the device 10 includes an air bag 20 retained in an air bag housing 22, such as a casing or a tub. In various exemplary embodiments, the air bag 20 may be a pneumatic air bag. Additionally, the air bag 20 will include one or more valves, such as input and bleed valves, which are usable to vary the pressure of the air within the air bag when the air bag is activated, as will be described later. In general, the air bag 20 is maintained at a desired air pressure when the device 10 is installed in a vehicle by inputting air or bleeding air to increase or decrease, respectively, the air pressure based on changes in environmental conditions. For example, as the temperature of the air in the air bag 20 increases or decreases, the air pressure will change and air will need to be added or released to return the air pressure to the desired value.

The device 10, including the air bag 22 housing and air bag 20 having an internal bladder 21, is installed on the vehicle 14, for example to a vehicle floor pan 15. The air bag housing 22 includes one or more mounting holes 30 usable to locate and attach the air bag housing to the vehicle false floor pan 15*a* separated from the belly floor pan 15. For example, the mounting holes 22 are usable to install bolts, screws, other fasteners, or the like to mount the air bag housing to the vehicle false floor pan. While the bottom of the vehicle may be subject to the brunt of a blast as the vehicle travels over an explosive device, it should be understood that the air bag housing 22, and the associated air bag 20 may be installed in any area of the vehicle and cabin space, not just the floor, to provide the desired blast dissipation protection.

The air bag housing 22 includes a flange 26 around the outer rim of its top surface 28. This flange 26 provides mounting points or mounting holes 30 for a suspended floor 32. The air bag housing has guides 34*a* that mates with guide pins 34 provided on the suspended floor 32. By mating the guide pins 34 with the guides 34*a*, the floor 32 can be positioned in a desired orientation and allowed to move or float freely in the vertical direction while otherwise maintaining its horizontal and rotational orientation.

In the event of malfunction in the system securing the suspended floor 32 to the retaining plate 36 is accomplished by one or more locking brackets 38 along with one or more locking pins 39. The locking brackets 38 extend through apertures 36*a* in the retaining plate 36 and mate with the locking pins 39 such that the suspended floor 32 is secured to the retaining plate 36. For example, if the air bag 20 becomes damaged and cannot be inflated to press the suspended floor 32 against the retaining plate 36, the locking brackets 38 and pins 39 may be utilized to ensure that the suspended floor remains in a desired position against the retaining plate for continued service of the vehicle.

An absorbent mat 40 is provided on top off the suspended floor 32 and its retaining plate 36. The absorbent mat 40 can be any commercially available blast mitigation floor mats Ex. SKYDEX floor mats.

In a blast event the high accelerations are experienced by the floor pan in extremely short time of the order of 3 Msec. to 5 Msec. The suspended floor system requires some time to sense the event via diaphragm 44 and react to the event via pressure valve 42 to deflate the air from the air bag to lower the suspended floor 32 absorbing the energy while displacing. During the initial phase 3 Msec. to 5 Msec. the suspended floor 32 still compressed against retaining plate 36 provides a stable floor against to which the energy absorbing floor mats can react providing the initial or first stage energy absorption via compression and/or collapse of the energy absorbing floor mat 40 through its thickness. Thus, the energy absorbing mat 40 provides the first stage of protection for the occupants of the vehicle from the blast forces exerted on the vehicle floor pan 15 or 15*a*.

Although the absorbent mat 40 provides an initial level of protection against a blast, it is the activation of the air bag 20, which provides a significant second level of protection to the vehicle occupants. Activation of the air bag 20 is accomplished through a series of valves, specifically an input valve (not shown), which initially fills the air bag bladder 21 with air, and an output or check valve 42. The check valve or valves 42 are one-way valves that bleed air from the air bag at regulated rate when the valve is activated. Activation of the air bag 20 in the event of a blast is accomplished by a blast sensing apparatus 44. The blast sensing apparatus 44 is a diaphragm connected to the check valve. The sensing apparatus 44 and/or a diaphragm are located under the belly of the vehicle. There can be multiple diaphragms fairly distributed under the belly to sense the blast event around any location under the belly. The diaphragm 44 reacts to a blast force against the floor pan 15 of the vehicle by deforming; the deformation of this diaphragm activates the check valve 42 releasing the air from the airbag 21. Because the check valve 42 is a one-way valve, it allows the air to move in only a single direction out of the air bag. It should be understood that multiple check valves may be incorporated as one or more of the bleed valves, and as well, there may be other methods of activation. Additionally, a monitoring system (not shown), manual or electronic, that controls the air pressure of the air bag, may also be included in the present system for regulating the air pressure within the air bag.

In operation, the various components of the blast dissipation device 10 work separately and in conjunction to dissipate at least some of the energy exerted on the underbelly of a vehicle cause by, for example, the explosion of an IED below the vehicle. In various exemplary embodiments, when an IED, or similar explosive device, is detonated below the vehicle, the force of the explosion causes the floor pan 15 of the vehicle 14 to deform. This deformation in turn forces the safety floor against the lower extremities of any occupants of the vehicle. The absorbent mat 40, acting as a first absorption system, deforms to help dissipate the initial force being exerted on the lower extremities of the occupants and thereby reduce the likelihood of injury to the occupants.

As the floor pan continues to deform, the diaphragm 44 likewise deforms. After the diaphragm 44 has deformed to a sufficient level, it will activate the check valve 42 and initiate a controlled release of the air pressure within the air bag 20. This controlled release of air from the air bag can be controlled by adjusting the flow rate of air through the check valve 42, thereby adjusting the level of deformation of the diaphragm that is necessary to activate the check valve, or otherwise adjusting the system.

The controlled release of the air pressure within the air bag 20, which acts as a second absorption system, helps dissipate the energy exerted on the floor pan such that the energy is not transferred onto the occupants of the vehicle. The floor pan 15 is thus allowed to move a greater distance relative to the occupants of the vehicle without causing harm to those occupants.

It should be appreciated that the above-referenced forces may include general deformation forces, localized deformation forces, general displacement forces, localized displacement forces, or any other force that may be exerted upon the underbelly of a vehicle.

It should also be appreciated that, while the above discussion is related to deformation forces caused by, for example, IED explosions, the invention may be usable to dissipate other forces, such as, for example, blunt forces impacts, grenade detonations, small arms fire, and any other force that may be exerted upon the underbelly of a vehicle.

What is claimed is:

1. A blast dissipation device usable within the interior of a personnel cabin of a vehicle, the device comprising:

a first stage absorption system responsive immediately to blast forces exerted on an underbelly of the vehicle to dissipate the blast forces; and a second stage absorption system responsive after the first stage absorption system to further dissipate the blast forces, wherein the second absorption system is an air bag system comprising:

a bladder;

at least one input valve;

at least one release valve; and a blast sensing diaphragm.

2. The blast dissipation device of claim 1, wherein the first stage absorption system is an absorbent mat.

3. The blast dissipation device of claim 1, wherein the device further comprises a suspended floor provided between the air bag and the first absorption system.

4. The blast dissipation device of claim 3, wherein the suspended floor is displaced in a vertical direction in response to a force exerted upon the underbelly of the vehicle.

5. The blast dissipation device of claim 4, wherein the suspended floor is positioned in a non-vertical direction by one or more guide pins.

6. The blast dissipation device of claim 1, wherein the diaphragm deforms in response to a blast force exerted upon the underbelly of the vehicle to a predetermined limit, activating the at least one release valve to release air from within the bladder to dissipate the blast forces exerted upon the underbelly of the vehicle.

7. The blast dissipation device of claim 6, wherein the first absorption system is responsive to the blast forces exerted upon the underbelly of the vehicle to dissipate those blast forces until the diaphragm has activated the at least one release valve.

8. The blast dissipation device of claim 1, wherein the second absorption system is responsive within 5 milliseconds of the initial impact of the blast force upon the underbelly of the vehicle.

9. The blast dissipation device of claim 8, wherein the second absorption system is responsive within 3 milliseconds of the initial impact of the blast force upon the underbelly of the vehicle.

10. A method of absorbing at least a portion of a blast force exerted upon the underbelly of a vehicle, the method comprising the steps of:

activating a first absorption system to dissipate an initial blast force exerted upon the underbelly of the vehicle; and, activating a second absorption system to dissipate the remaining blast force exerted upon the underbelly of the vehicle, wherein the second absorption system is activated after the first absorption system, wherein the step of activating the second absorption system comprises:

deforming a diaphragm of an air bag system;

activating a release valve of the air bag system; and releasing air from within a bladder of the air bag system to lower an air pressure of the air bag system.

11. The method of claim 10, further comprising the steps of dissipating a maximum amount of the initial blast force with the first absorption system before activating the second absorption system.

12. The method of claim 10, wherein the step of activating the first absorption system comprises deforming an energy absorbing mat.

13. The method of claim 12, wherein the step of deforming the energy absorbing mat comprises displacing a suspended floor in a vertical direction against the absorbing mat.

14. The method of claim 10 wherein:

activating the first absorption system comprises displacing a suspended floor to deform an absorbing mat;

activating the second absorption system comprises:

deforming a diaphragm of an air bag system;

activating a release valve of the air bag system; and releasing air from within a bladder of the air bag system to lower an air pressure of the air bag system; and wherein the release valve is activated after the absorbing mat has been at least partially deformed.

* * * * *